US008247961B2

(12) United States Patent
Hao et al.

(10) Patent No.: US 8,247,961 B2
(45) Date of Patent: Aug. 21, 2012

(54) FIELD EMISSION CATHODE DEVICE AND DISPLAY USING THE SAME

(75) Inventors: Hai-Yan Hao, Beijing (CN); Peng Liu, Beijing (CN); Jie Tang, Beijing (CN); Yang Wei, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/213,271

(22) Filed: Aug. 19, 2011

(65) Prior Publication Data

US 2011/0304260 A1 Dec. 15, 2011

Related U.S. Application Data

(63) Continuation of application No. 12/771,041, filed on Apr. 30, 2010, now Pat. No. 8,030,837.

(30) Foreign Application Priority Data

Oct. 29, 2009 (CN) ..... 2009 1 0110440

(51) Int. Cl.
*H01J 17/49* (2012.01)

(52) U.S. Cl. ..... 313/495; 313/497

(58) Field of Classification Search ..... 313/495–497
See application file for complete search history.

(56) References Cited

U.S. PATENT DOCUMENTS

2005/0221710 A1 10/2005 Shiroishi et al.
2006/0175950 A1 8/2006 Itou et al.
2006/0261725 A1 11/2006 Lee
2007/0284987 A1 12/2007 Liu et al.

*Primary Examiner* — Anne Hines
(74) *Attorney, Agent, or Firm* — Altis Law Group, Inc.

(57) ABSTRACT

A field emission cathode device includes an insulative substrate, a number of cathode electrodes, and a number of liner electron emission units. The insulative substrate has a top surface and a bottom surface. The insulative substrate defines a number of openings. The cathode electrodes are located on the bottom surface. Each of the linear electron emission units has a first portion secured between the insulative substrate and one corresponding cathode electrode and a second portion received in one corresponding opening.

12 Claims, 9 Drawing Sheets

FIELD EMISSION CATHODE DEVICE AND DISPLAY USING THE SAME

RELATED APPLICATIONS

This application is a continuation application of U.S. patent application Ser. No. 12/771,041, filed Apr. 30, 2010, entitled, "FIELD EMISSION CATHODE DEVICE AND DISPLAY USING THE SAME," which claims all benefits accruing under 35 U.S.C. §119 from China Patent Application No. 200910110440.1, filed on Oct. 29, 2009 in the China Intellectual Property Office.

BACKGROUND

1. Technical Field

The present disclosure relates to a field emission cathode device based on carbon nanotubes, and display using the same.

2. Description of Related Art

Field emission displays (FEDs) are a new, rapidly developing flat panel display technology. Generally, FEDs can be roughly classified into diode and triode structures. In particular, carbon nanotube-based FEDs have attracted much attention in recent years.

Field emission cathode devices are important elements in FEDs. A field emission cathode device based on carbon nanotubes for triode FEDs usually includes an insulating substrate, a number of longitudinal cathodes attached on the substrate, a number of electron emission units including carbon nanotubes distributed on the cathodes, a dielectric layer, and a number of gate electrodes directly mounted on the top of the dielectric layer. Usually, the carbon nanotubes of the electron emission unit are fabricated on the cathode by chemical vapor deposition (CVD). However, the carbon nanotubes fabricated by CVD are not secured on the cathode. Thus, the carbon nanotubes tend to be pulled out from the cathode by a strong electric field force causing the field emission cathode device to have a short life.

What is needed, therefore, is a field emission cathode device that can overcome the above-described shortcomings and a display using the same.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission cathode device and display using the same. The field emission cathode device can be applied to a diode FEDs or a triode FEDs.

Figure 1:
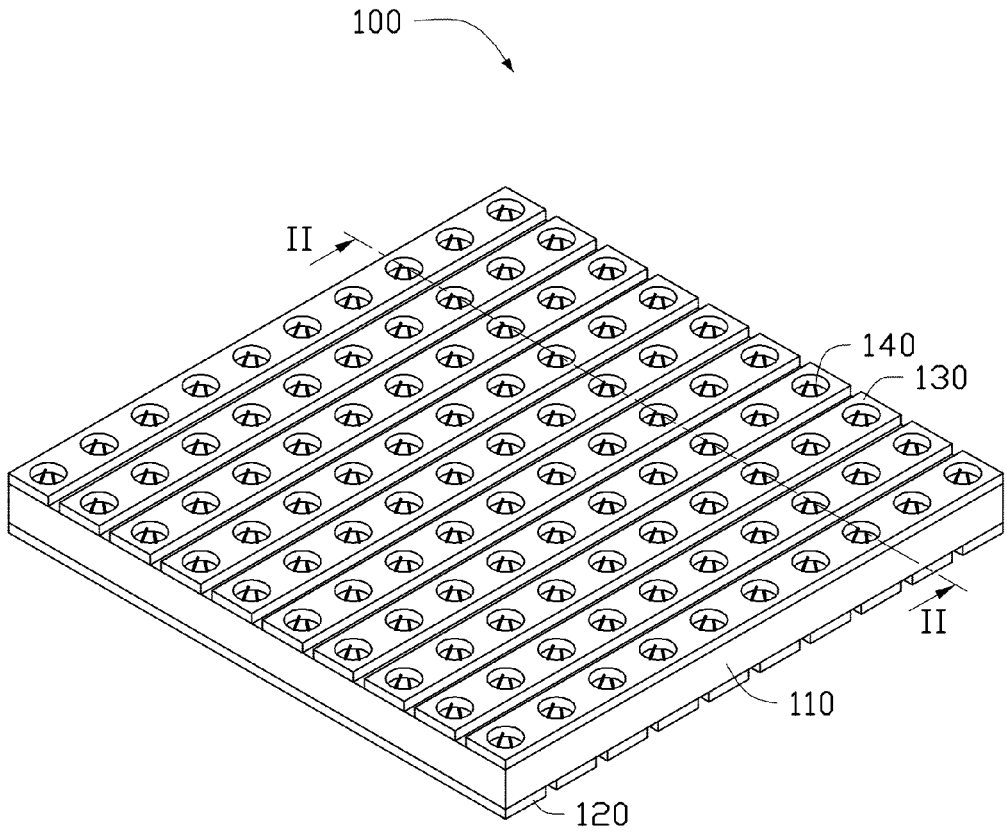
FIG. 1 is a schematic view of one embodiment of a field emission cathode device.
Figure 2:
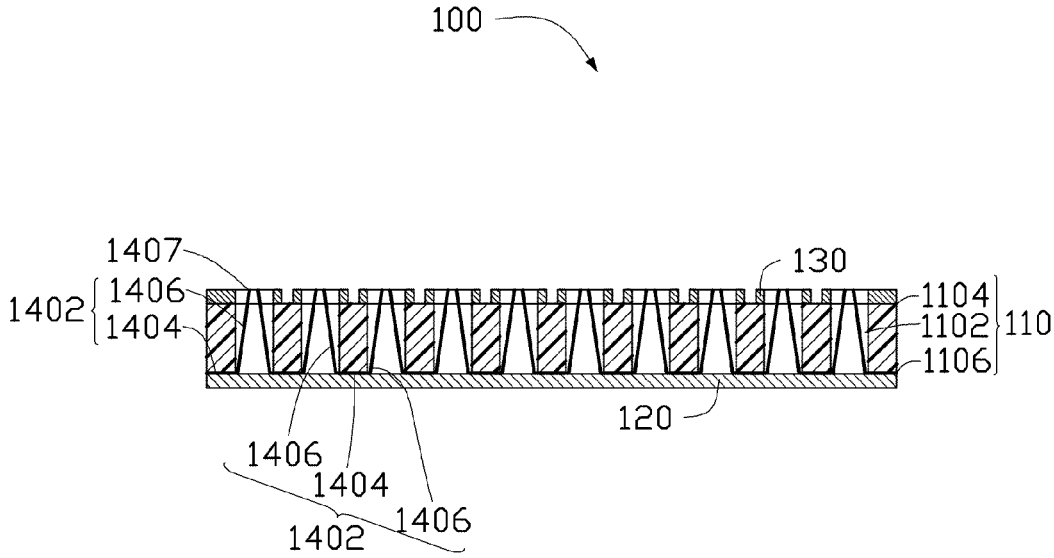
FIG. 2 is a schematic, cross-sectional view, along a line II-II of FIG. 1.

Referring to FIGS. 1 and 2, a field emission cathode device 100 of one embodiment includes an insulative substrate 110, a plurality of cathode electrodes 120, a plurality of gate electrodes 130 and a plurality of electron emission units 140.

The insulative substrate 110 includes a top surface 1104 and a bottom surface 1106. The insulative substrate 110 defines a plurality of openings 1102. The openings 1102 extend through from the bottom surface 1106 to the top surface 1104. The cathode electrodes 120 are substantially parallel to each other and located at the bottom surface 1106. The gate electrodes 130 are substantially parallel to each other and located on the top surface 1104. Alignment directions of the cathode electrodes 120 intersect alignment directions of the gate electrodes 130. The extending direction of the cathode electrodes 120 can be substantially perpendicular to the extending direction of the gate electrodes 130. Each of the electron emission units 140 corresponds to one of the openings 1102 and is electrically connected to one corresponding cathode electrode 120. Each opening 1102 is covered by one of corresponding cathode electrodes 120. At least one portion of each electron emission unit 140 is fixed between the insulative substrate 110 and the corresponding cathode electrodes 120. Each of the electron emission units 140 is controlled by the one of the cathode electrodes 120, and one of the gate electrodes 130 and electrons can be independently emitted.

The insulative substrate 110 can be made of insulative material. The insulative material can be ceramics, glass, resins, quartz, or polymer. A size, a shape and a thickness of the insulative substrate 110 can be chosen according to need. The insulative substrate 110 can be square plate or rectangular plate with a thickness greater than 15 micrometers. The openings 1102 can be arranged according to a certain pattern. A diameter of each opening 1102 can range from about 3 micrometers to about 3 millimeters. In one embodiment, the insulative substrate 110 is a square polymer plate with a thickness of about 1 millimeter, an edge length of about 50 millimeters. The openings 1102 are arranged in a matrix, and the number of the openings 1102 is 10×10 (10 rows, 10 openings 1102 on each row). The diameter of each opening 1102 is about 2 millimeters.

The cathode electrodes 120 can be made of metal, alloy, conductive slurry, or indium tin oxide (ITO). The metal can be copper, aluminum, gold, silver or iron. The conductive slurry can include from about 50% to about 90% (by weight) of the metal powder, from about 2% to about 10% (by weight) of the glass powder, and from about 8% to about 40% (by weight) of the binder. In one embodiment, the cathode electrodes 120 are strip-shaped copper sheets.

The gate electrodes 130 can be made of material the same as the material of cathode electrodes 120. A plurality of through holes (not labeled) can be defined by the gate electrodes 130 and be in alignment with the openings 1102. A diameter of each hole can range from about 1 micrometer to about 3 millimeters. Each of the through holes corresponds to one of the openings 1102 so that the electron emission units 140 can be exposed. The gate electrodes 130 are optional. When the field emission cathode device 100 is applied to a diode FEDs, the field emission cathode device 100 can have no gate electrodes 130. In one embodiment, the gate electrodes 130 are strip-shaped conductive films made by printing conductive slurry.

Figure 3:
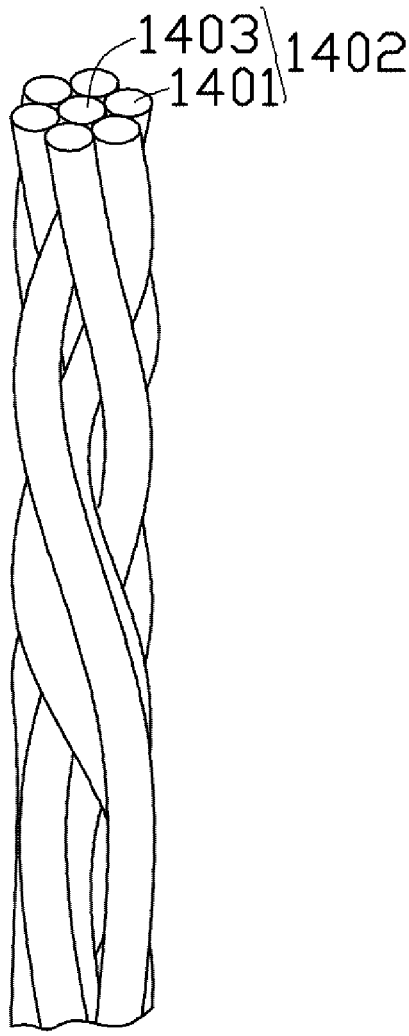
FIG. 3 is a schematic view of one embodiment of a linear carbon nanotube structure.

Each of the electron emission units 140 can include at least one linear carbon nanotube structure 1402. The linear carbon nanotube structure 1402 can include at least one carbon nanotube wire and/or at least one carbon nanotube cable. A carbon nanotube cable includes two or more carbon nanotube wires. The carbon nanotube wires in the carbon nanotube cable can be, twisted or untwisted. In an untwisted carbon nanotube cable, the carbon nanotube wires are substantially parallel with each other. In a twisted carbon nanotube cable, the carbon nanotube wires are twisted with each other. A diameter of the linear carbon nanotube structure can range from about 50 micrometers to about 500 micrometers. Referring to FIG. 3, in one embodiment, the linear carbon nanotube structure 1402 can include at least one supporting wire 1403 and at least one carbon nanotube wire 1401. The supporting wire 1403 can be substantially parallel with or twisted with the carbon nanotube wires 1401. The supporting wire 1403 can be a metal wire such as copper wire, aluminum wire, silver wire, or gold wire. The supporting wire 1403 is used to support the carbon nanotube wires 1401.

Figure 4:
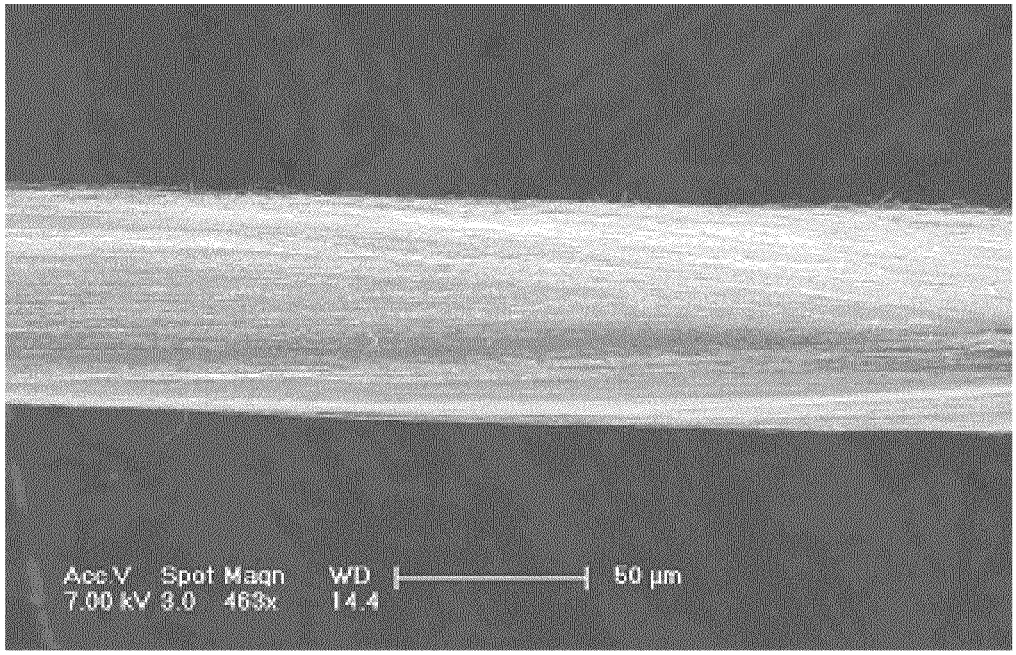
FIG. 4 is a Scanning Electron Microscope (SEM) image of an untwisted carbon nanotube wire.

The carbon nanotube wire can be untwisted or twisted. The untwisted carbon nanotube wire can be obtained by treating a drawn carbon nanotube film, drawn from a carbon nanotube array with a volatile organic solvent. Examples of drawn carbon nanotube film, also known as carbon nanotube yarn, or nanofiber yarn, ribbon, and sheet are taught by U.S. Pat. No. 7,045,108 to Jiang et al., and WO 2007015710 to Zhang et al. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. Referring to FIG. 4, the untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire can range from about 0.5 nanometers to about 100 micrometers. Examples of carbon nanotube wire are taught by US PGPub. 20070166223A1 to Jiang et al.

Figure 5:
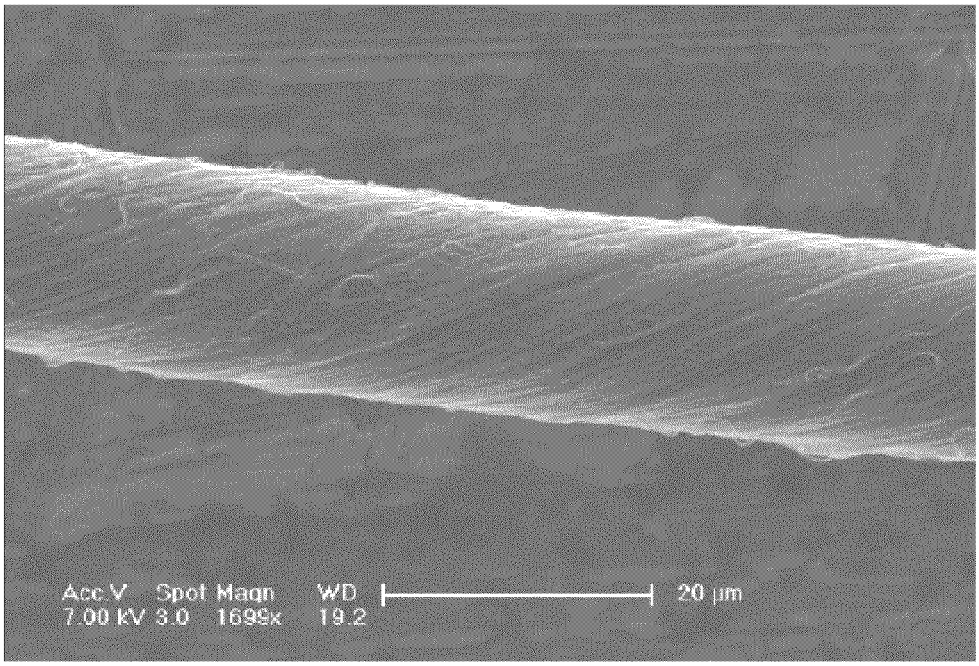
FIG. 5 is an SEM image of a twisted carbon nanotube wire.

The twisted carbon nanotube wire can be formed by twisting the drawn carbon nanotube film using a mechanical force to turn the two ends of the drawn carbon nanotube film in opposite directions. Referring to FIG. 5, the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallel to each other, and joined by van der Waals attractive force therebetween. Length of the carbon nanotube wire can be set as desired. A diameter of the twisted carbon nanotube wire can be from about 0.5 nanometers to about 100 micrometers. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent is volatilizing. The specific surface area of the twisted carbon nanotube wire will decrease, while the density and strength of the twisted carbon nanotube wire will be increased. The carbon nanotubes in the carbon nanotube wire can be single-walled, double-walled, or multi-walled carbon nanotubes.

Figure 6:
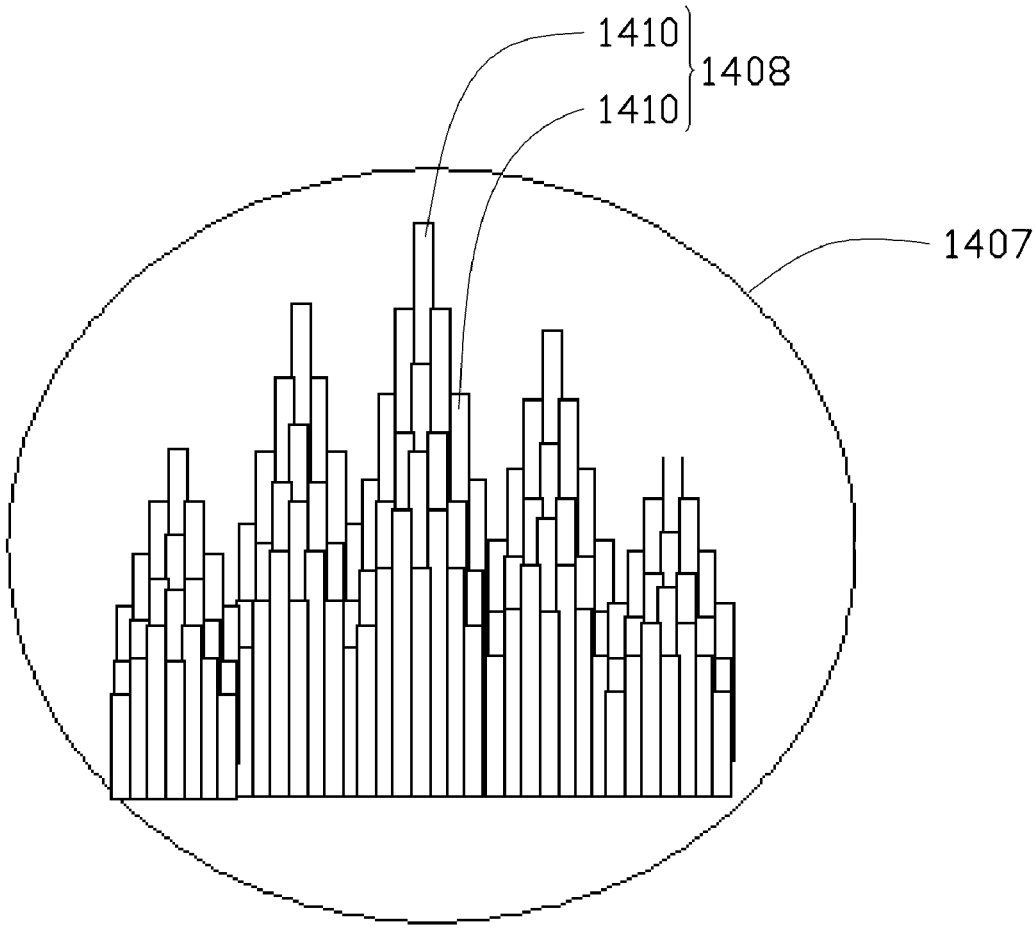
FIG. 6 is a schematic view of one embodiment of a field emission end of a linear carbon nanotube structure of a field emission cathode device.
Figure 7:
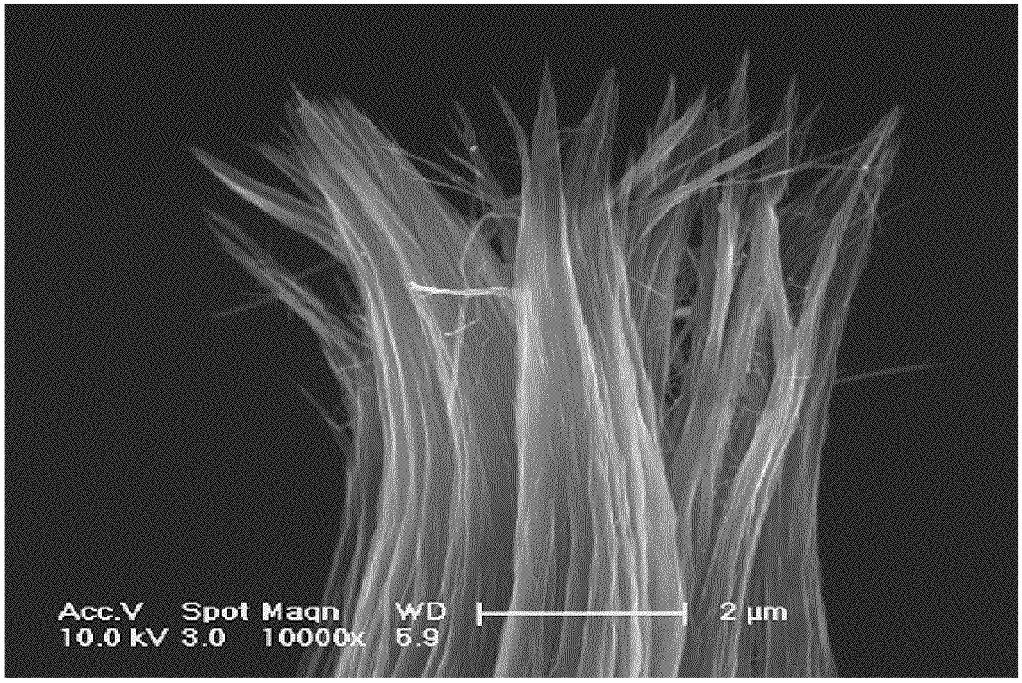
FIG. 7 is an SEM image of a field emission end of a linear carbon nanotube structure of a field emission cathode device.

Referring to FIG. 2, the linear carbon nanotube structure 1402 includes a fixing portion 1404 and a field emission portion 1406 connected to the fixing portion 1404. The fixing portion 1404 of the linear carbon nanotube structure 1402 is fixed between the insulative substrate 110 and the cathode electrodes 120. At least one portion of the field emission portion 1406 is received in the corresponding opening 1102. The field emission portion 1406 extends and inclines from a position where an inner surface of the openings 1102 contacts the cathode electrodes 120 to a center axis (not shown) of the openings 1102. The field emission portion 1406 can include a field emission end 1407. The field emission end 1407 can be positioned near or in the center axis of the openings 1102. The field emission end 1407 can be positioned in or out of the hole of the gate electrodes 130. A distance between a top surface (not labeled) of the gate electrodes 130 and the field emission end 1407 can be less than 5 micrometers so that the controlling voltage of the gate electrodes 130 can be in a range from about 30 volts to about 100 volts. The shape of the field emission end 1407 can be a cone. Referring to FIGS. 6 and 7, the field emission end 1407 can include a plurality of field emission tips 1408. Each of the field emission tips 1408 can include a plurality of carbon nanotubes 1410 parallel to each other and joined by van der Waals attractive force therebetween. A single carbon nanotube 1410 can be taller and project over other carbon nanotubes 1410.

In one embodiment, each of the electron emission units 140 includes two linear carbon nanotube structures 1402 as shown in FIG. 2. The fixing portion 1404 of each linear carbon nanotube structure 1402 is fixed between the insulative substrate 110 and the corresponding cathode electrode 120. As shown in FIG. 2, some linear carbon nanotube structures 1402, corresponding to adjacent openings 1102 can have a common fixing portion 1404 fixed between the insulative substrate 110 and the cathode electrodes 120. The two field emission ends 1407 corresponding to each opening 1102 are positioned near the center axis of the openings 1102 and spaced from each other. A distance between a top surface of the gate electrodes 130 and the field emission end 1407 is less than 2 micrometers so that the controlling voltage of the gate electrodes 130 is in a range from about 70 volts to about 80 volts.

Figure 8:
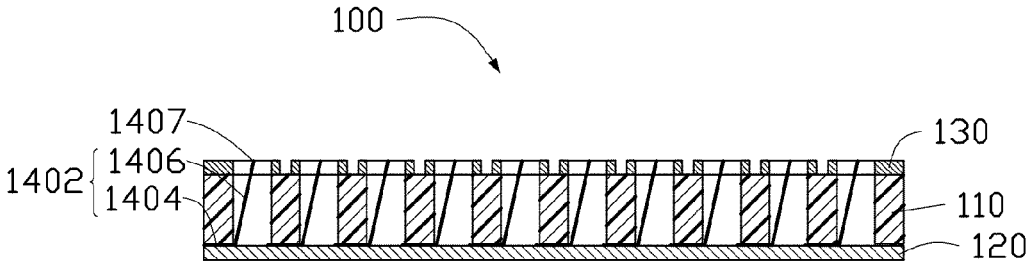
FIG. 8 is a schematic side view of another embodiment of a field emission cathode device.

In another embodiment, each of the electron emission units 140 includes only one linear carbon nanotube structure 1402 as shown in FIG. 8. The field emission end 1407 of the linear carbon nanotube structure 1402 is positioned in the center axis of the openings 1102 and in the hole of the gate electrodes 130.

Further more, a conductive layer (not shown) can be located between the insulative substrate 110 and the gate electrodes 130, or on an inner surface of the openings 1102. The conductive layer is electrically connected to the gate electrodes 130 and insulated from the electron emission units 140. The conductive layer can conduct the electrons stroked on the conductive layer and prevent the electrons emitted from the electron emission units 140 from striking the insulative substrate 110 and producing secondary electrons.

In the field emission cathode device 100, the fixing portion 1404 of each linear carbon nanotube structure 1402 is fixed between the insulative substrate 110 and the cathode electrodes 120. Thus, the electron emission units 140 are secured and cannot be pulled out from the cathode electrode 120 by electric field force in a strong electric field. The field emission cathode device 100 has a long life.

Figure 9:
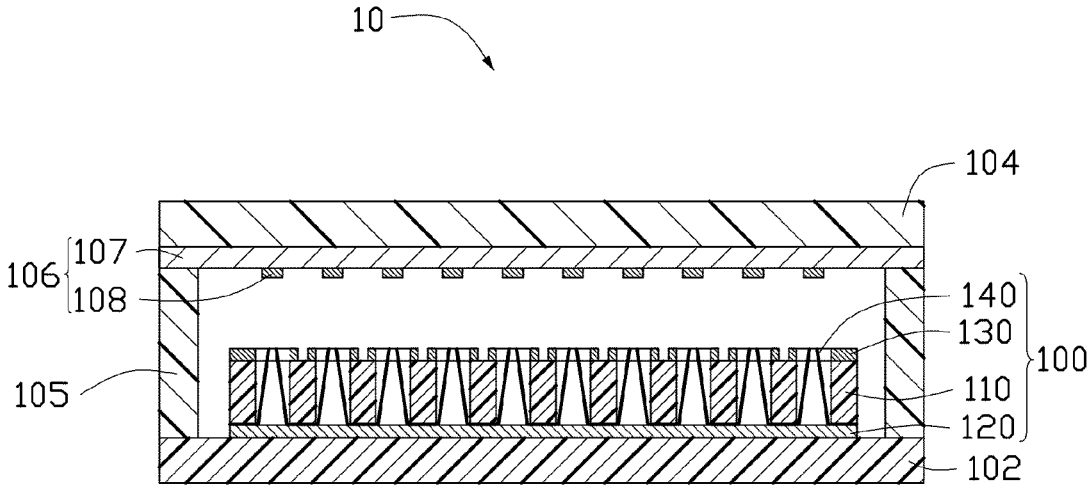
FIG. 9 is a schematic side view of one embodiment of a display using the field emission cathode device of FIG. 1.

Referring to FIG. 9, a display 10 of one embodiment includes a cathode substrate 102, an anode substrate 104, a field emission cathode device 100, and a field emission anode device 106. The field emission cathode device 100 has been described above.

The cathode substrate 102 and the anode substrate 104 are connected by an insulative supporter 105. The field emission cathode device 100 and the field emission anode device 106 are sealed between the cathode substrate 102 and the anode substrate 104. The field emission cathode device 100 and the field emission anode device 106 are spaced from each other and opposite to each other. The field emission cathode device 100 is located on a surface of the cathode substrate 102 and the field emission anode device 106 is located on a surface of the anode substrate 104.

The cathode substrate 102 can be made of an insulative material such as ceramics, glass, quartz, or silicon dioxide. The anode substrate 104 can be made of a transparent material such as glass. In one embodiment, both the cathode substrate 102 and the anode substrate 104 are glass plate.

The field emission anode device 106 can include an anode electrode 107 located on an inner surface of the anode substrate 104 and a fluorescent layer 108 located on a surface of the anode electrode 107. The anode electrode 107 can be an ITO film or a carbon nanotube film. The fluorescent layer 108 can include a plurality of luminescent units (not labeled). Each of the luminescent units corresponds to one of the electron emission units 140.

Finally, it is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A field emission cathode device, comprising:

an insulative substrate having a top surface and a bottom surface, and the insulative substrate defining a plurality of openings;

a plurality of cathode electrodes attached to the bottom surface; and a plurality of linear electron emission units each having a first portion and a second portion, wherein the first portion is attached to the bottom surface and secured between the insulative substrate and one corresponding cathode electrode, the second portion is received in one corresponding opening, and each of the plurality of electron emission units comprises a carbon nanotube wire comprising a plurality of carbon nanotubes substantially oriented along a length direction of the carbon nanotube wire or helically oriented around an axial direction of the carbon nanotube wire.

2. The field emission cathode device of claim 1, wherein the carbon nanotube wire comprises a fixing portion and a field emission portion connected to the fixing portion; and the fixing portion is fixed between the insulative substrate and the one corresponding cathode electrode, and the field emission portion is received in the one corresponding opening.

3. The field emission cathode device of claim 2, wherein the field emission portion comprises a field emission end; the field emission end comprises a plurality of field emission tips.

4. The field emission cathode device of claim 3, wherein each of the plurality of field emission tips comprises a plurality of carbon nanotubes parallel to each other and joined by van der Waals attractive force therebetween.

5. The field emission cathode device of claim 4, wherein in the field emission tip, a single carbon nanotube is taller than and projects over other carbon nanotubes.

6. The field emission cathode device of claim 3, wherein the field emission end is positioned in a center axis of the one corresponding opening.

7. The field emission cathode device of claim 3, further comprising a plurality of gate electrodes located on the top surface of the insulative substrate.

8. The field emission cathode device of claim 7, wherein a distance between the field emission end and a top surface of one corresponding gate electrode is less than 5 micrometers.

9. The field emission cathode device of claim 3, wherein each of the electron emission units comprises two or more carbon nanotube wires, and the field emission ends of the two or more carbon nanotube wires are positioned near center axes of the plurality of openings and spaced from each other.

10. The field emission cathode device of claim 9, wherein some of the carbon nanotube wires corresponding to adjacent openings have a common fixing portion fixed between the insulative substrate and the one corresponding cathode electrode.

11. A field emission cathode device, comprising:

an insulative substrate having a top surface and a bottom surface, and the insulative substrate defining an opening;

a cathode electrode attached to the bottom surface; and a linear carbon nanotube structure comprising a plurality of carbon nanotubes substantially oriented along a length direction of the linear carbon nanotube structure or substantially helically oriented around an axial direction of the linear carbon nanotube structure, wherein the linear carbon nanotube structure has a fixing portion and a field emission portion connected to the fixing portion, the fixing portion is attached to the bottom surface and secured between the insulative substrate and the cathode electrode, and the field emission portion is received in the opening.

12. A field emission cathode device, comprising:

an insulative substrate having a top surface and a bottom surface, and the insulative substrate defining a plurality of openings;

a plurality of cathode electrodes attached to the bottom surface; and a plurality of linear electron emission units each having a first portion and a second portion, wherein the first portion is attached to the bottom surface and secured between the insulative substrate and one corresponding cathode electrode, the second portion is received in one corresponding opening, and each of the plurality of electron emission units comprises a carbon nanotube wire and a metal supporting wire substantially parallel with or twisted with the carbon nanotube wire.

* * * * *